United States Patent [19]

White

[11] 4,201,582

[45] May 6, 1980

[54] PHOTOTHERMOGRAPHIC AND THERMOGRAPHIC ELEMENT, COMPOSITION AND PROCESS

[75] Inventor: Richard L. White, Rochester, N.Y.

[73] Assignee: Eastman Kodak Company, Rochester, N.Y.

[21] Appl. No.: 643,462

[22] Filed: Dec. 22, 1975

Related U.S. Application Data

[63] Continuation-in-part of Ser. No. 466,331, May 2, 1974, abandoned.

[51] Int. Cl.[2] ..... G03C 5/24; G03C 1/02

[52] U.S. Cl. ..... 430/351; 430/965; 430/619

[58] Field of Search ..... 96/114.1, 109, 76 R, 96/48 HD

[56] References Cited

U.S. PATENT DOCUMENTS

| | | | |
|---|---|---|---|
| 2,432,506 | 12/1947 | Chilton et al. | 96/61 |
| 2,573,027 | 10/1951 | Kendall et al. | 96/52 |
| 3,040,047 | 6/1962 | Sirakawa | 96/109 |
| 3,314,789 | 4/1967 | White et al. | 96/29 |
| 3,396,017 | 8/1968 | Bacon et al. | 96/27 |
| 3,617,289 | 11/1971 | Ohkubo et al. | 96/114.1 |
| 3,640,719 | 2/1972 | Von Konig et al. | 96/109 |
| 3,776,728 | 12/1973 | Suzuki et al. | 96/76 R |
| 3,785,830 | 1/1974 | Sullivan et al. | 96/114.1 |
| 3,832,186 | 8/1974 | Masuda et al. | 96/114.1 |
| 3,837,857 | 9/1974 | Abbott | 96/109 |

OTHER PUBLICATIONS

Article #12542, of "Research Disclosure", Sep. 1974.

*Primary Examiner*—J. Travis Brown
*Attorney, Agent, or Firm*—Richard E. Knapp

[57] ABSTRACT

Certain mercapto heterocyclic compounds in certain photothermographic and thermographic elements and compositions containing silver salts of certain heterocyclic thione compounds and an organic reducing agent for the silver salts provide improved developed image tone. In the photothermographic element comprising photographic silver halide in association with the silver salt of heterocyclic thione, a developed and stabilized image, in the absence of a separate stabilizer or stabilizer precursor, with improved tone, is provided by heating the element. The photothermographic element and composition can contain a binder.

23 Claims, No Drawings

PHOTOTHERMOGRAPHIC AND THERMOGRAPHIC ELEMENT, COMPOSITION AND PROCESS

This is a continuation-in-part application of U.S. application Ser. No. 466,331 of White, filed May 2, 1974, abandoned.

BACKGROUND OF THE INVENTION

1. Field of the Invention

This invention relates to mercapto heterocyclic toning agents in photothermographic compositions and elements comprising silver salts of certan heterocyclic thione compounds and to photothermographic processes for preparing developed images with them. In another aspect the invention relates to such photothermographic elements, compositions and processes comprising photographic silver halide in association with the silver salt of certain heterocyclic thiones. A further aspect of the invention relates to thermographic elements, compositions and processes wherein the described toning agent provides improved tone.

2. Description of the State of the Art

Photothermographic materials comprising a photosensitive component such as photographic silver halide with a silver salt of certain heterocyclic thione compounds are described, for example, in U.S. Pat. No. 3,785,830 issued Jan. 15, 1974. Such photothermographic elements comprise (a) a photosensitive component consisting essentially of photographic silver halide, such as photographic silver iodide, (b) a reducing agent, and (c) a silver salt of a thione compound, such as a silver salt of a thiazoline-2-thione, benzothiazoline-2-thione, imidazoline-2-thione or oxazoline-2-thione. These photothermographic elements and compositions can provide a developed image which is stable in the absence of a separate stabilizing compound. The problem encountered with these photothermographic elements and compositions is that the developed image resulting from them does not have the desired black tone. Also, the maximum density is often less than desired.

None of the art describing various photothermographic elements and compositions has provided a useful answer to this tone problem. Typical photothermographic elements are described, for example, in U.S. Pat. No. 3,152,904 of Shepard et al, issued Oct. 13, 1964; U.S. Pat. No. 3,392,020 of Yutzy et al, issued July 9, 1968; U.S. Pat. No. 3,457,075 of Morgan et al, issued July 22, 1969 and U.S. Pat. No. 3,672,904 of deMauriac, issued June 27, 1972. Toning agents known in these photothermographic materials and toning agents known in thermographic materials have not, as a class, provided a satisfactory solution to the described tone problem.

Heterocyclic mercapto compounds, as a class, do not provide a useful solution to this problem. Heterocyclic mercapto compounds have been used for various purposes in photographic elements, such as photothermographic elements. Such heterocyclic mercapto compounds in photographic and photothermographic elements are described, for example, in U.S. Pat. No. 3,617,289 of Ohkubo et al, issued Nov. 2, 1971; U.S. Pat. No. 3,396,017 of Bacon et al, issued Aug. 6, 1968; U.S. Pat. No. 3,017,270 of Tregillus et al, issued Jan. 16, 1962; U.S. Pat. No. 2,573,027 of Kendall et al, issued Oct. 30, 1951; U.S. Pat. No. 2,590,775 of Kendall et al, issued Mar. 25, 1952; U.S. Pat. No. 2,432,506 of Chilton et al, issued Dec. 16, 1947; Canadian Pat. No. 905,191 issued July 18, 1972 and Belgian Pat. No. 768,071 issued July 30, 1971. The fact that heterocyclic mercapto compounds as a class do not provide the desired toning results is demonstrated in comparative examples in following Table II.

There has been a need to provide photothermographic elements, compositions and processes which produce improved tone in a developed image wherein the photothermographic elements and compositions comprise photographic silver halide in association with a silver salt of certain heterocyclic thiones, as described herein, and an organic reducing agent. There has also been a need to provide thermographic elements, compositions and processes which provide improved tone wherein the thermographic composition or element comprises the described silver salt of certain thione compounds with an organic reducing agent. There has also been a need to provide developed images in such compositions and elements which are stable and do not require a separate stabilizer or stabilizer precursor component.

SUMMARY OF THE INVENTION

It has been found according to this invention that an improvement in image tone is provided with no significant adverse effect to sensitometric properties, by a photothermographic element and composition comprising (a) photographic silver halide in association with (b) an image-forming combination comprising (i) a silver salt of a heterocyclic thione wherein the heterocyclic thione is represented by the formula:

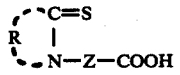

wherein R represents atoms completing a 5-member heterocyclic nucleus, Z is alkylene containing 1 to 30 carbon atoms, including both straight and branched chain alkylene, typically containing 1 to 10 carbon atoms, and (ii) an organic reducing agent, by (c) a toner which comprises certain mercapto heterocyclic compounds which satisfies a test as described herein. Preferably the toner is a compound selected from the group consisting of 3-mercapto-1H-1,2,4-triazole, 3-imino-5-thiourazole, 4-methyl-3,5-dithiourazole, 4-phenyl-3,5-dithiourazole, 4-(p-methoxyphenyl)-3,5-dithiourazole, 2,4-dimercaptopyrimidine, 8-mercaptopurine and 2,6-dimercaptopurine toners.

Photothermographic elements according to this invention comprise a support having thereon the described components of the photothermographic material containing the described toner in one or more layers. For example, all of the components of the photothermographic composition or thermographic composition can be coated in a single layer or they can be coated in two or more layers. For example, in a photothermographic element according to the invention, one layer can contain the photographic silver halide and one or more other layers can contain the reducing agent and the silver salt of the heterocyclic thione.

In a photothermographic material, as described, a visible image can be prepared by imagewise exposing the photothermographic material to suitable radiation, typically actinic radiation or visible light, and then overall heating the exposed element to a temperature and for a time which is sufficient to develop a desired visible image.

It has also been found according to the invention that a thermographic element or composition with improved tone is provided by certain mercapto heterocyclic toners in a thermographic element or composition comprising a described silver salt of a heterocyclic thione with an organic reducing agent. An image is provided in such a thermographic element or composition by imagewise heating the element or composition to a temperature and for a time which provides a visible desired image.

In addition to providing improved developed image tone, without the need for a separate stabilizer or stabilizer precursor, the photothermographic elements and compositions and the thermographic elements and compositions of the invention have other advantageous properties. Although the photothermographic material or thermographic material, as coated on a support, is initially opaque, upon heating to a temperature at which development of an image takes place, it becomes transparent in the non-image areas. This permits preparation of transparencies when the compositions are coated on a transparent support. It also permits the use of various colored layers under the photothermographic or thermographic material to provide a background of a desired color.

Additionally, the components of the photothermographic material and thermographic material according to the invention are such that useful coatings can be prepared without the need for a separate binder. This permits the elimination, if desired, of one of the components typically employed in a photothermographic or thermographic material.

DETAILED DESCRIPTION OF THE INVENTION

Certain toners can be used in the described photothermographic and thermographic materials according to the invention to provide improved tone. The toners of the invention consist of certain mercapto heterocyclic compounds. The choice of an optimum toner will depend upon such factors as the particular photothermographic or thermographic material, the desired image, processing temperature, and the like. Different tests can be used to determine operable mercapto heterocyclic toners according to the invention. One test which has been found useful for determining the mercapto heterocyclic toners useful herein is one in which a mercapto heterocyclic compound provides an average difference of 0.21 or less between (X) blue reflection density and (Y) visual reflection density, as measured, at a density of 1.0, in the following test:

(I) in an aqueous solvent is mixed (1) 3-carboxymethyl-4-methyl-4-thiazoline-2-thione silver salt, (2) t-butyl hydroquinone, (3) fine-grain photographic gelatino silver iodide emulsion wherein said silver iodide has an average grain size of about 0.01 micron to about 0.25 micron, and (4) a coating aid consisting essentially of nonylphenoxypolyglycidol;

(II) the mercapto heterocyclic toner is mixed into the resulting composition of step (I);

(III) the composition containing the mercapto heterocyclic toner is then coated onto a polyethylene coated paper support at the concentration which provides a coating containing, per square meter of support 0.75 g. of total silver of which 0.05 g. is contributed by the silver iodide, 1.88 g. of t-butyl hydroquinone, 0.22 g. of coating aid and 0.001 to 0.07 g. of the mercapto heterocyclic toner, and subsequently the resulting coating is dried to provide a photothermographic element (A);

(IV) the photothermographic element (A) is imagewise exposed to unfiltered tungsten light at least sufficient to provide a latent image which can provide a developed density of at least 1.0, then (V) the latent image is developed by heating the resulting exposed photothermographic element to a temperature of about 140° C. to about 170° C. for about 2 to about 8 seconds to provide a visible, developed image having a developed density of at least 1.0, and (VI) the difference between (X) blue reflection density and (Y) visual reflection density is measured at a density of 1.0.

In this test the difference between (X) blue reflection density and (Y) visual reflection density can be described as a delta D range also described herein as a ΔD range. In this test a mercapto heterocyclic compound which provides, at the described density, a difference, i.e., delta D range, between (X) blue reflection density and (Y) visual reflection density of 0.21 or less is considered useful as a toner in a photothermographic material according to the invention. Particularly useful are those compounds which provide a ΔD range of less than 0.15. In the test, as described, blue reflection density and visual reflection density are measured with conventional density measuring techniques and apparatus known in the photographic art. Values for blue reflection density and visual reflection density can be measured with a conventional densitometer employing conventional filters. The filters used for measuring the visual reflection density transmit radiation in the visible range of the spectrum of a developed image. The filters used for measuring blue reflection density transmit only radiation in the blue region of the spectrum.

In the described test for a useful toner, if the described photothermographic element in the test, upon imagewise exposure and then heating, does not provide a developed density of 1.0 or more, the photothermographic element is not considered to provide a useful developed image. In some cases, however, according to the invention, photothermographic materials which provide a developed image density of less than 1.0 can be useful for some limited purposes such as oscillograph recording.

One embodiment of the invention is: in a photothermographic element comprising a support having thereon (a) photographic silver halide in association with (b) an image-forming combination comprising (i) a silver salt of a heterocyclic thione, said heterocyclic thione being represented by the formula:

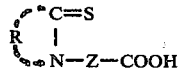

wherein R represents atoms completing a 5-member heterocyclic nucleus, Z is alkylene containing 1 to 30 carbon atoms, such as 1 to 10 carbon atoms, (ii) an organic reducing agent, and (c) a toner, the improvement wherein said toner comprises a mercapto heterocyclic compound which is selected from the group consisting of 3-mercapto-1H-1,2,4-triazole, 3-imino-5-thiourazole, 4-methyl-3,5-dithiourazole, 4-phenyl-3,5-dithiourazole, 4-(p-methoxyphenyl)-3,5-dithiourazole, 2,4-dimercaptopyrimidine, 8-mercaptopurine and 2,6-dimercaptopurine toners.

Useful toning agents in photothermographic and thermographic materials according to the invention are, for example, 3-mercapto-1H-1,2,4-triazole,
3-imino-5-thiourazole,
4-methyl-3,5-dithiourazole,
4-phenyl-3,5-dithiourazole,
4-(p-methoxyphenyl)-3,5-dithiourazole,
2,4-dimercaptopyrimidine,
8-mercaptopurine, and
2,6-dimercaptopurine.

In the definition of Z, as well as $Z^1$, $Z^2$ and $Z^3$, as employed herein, alkylene includes straight chain alkylene and branched chain alkylene, such as $$-CH_2\underset{\underset{CH_3}{|}}{CH}-,\quad -CH_2CH_2\underset{\underset{CH_2CH_3}{|}}{CH}-,\quad \text{and}\quad -\underset{\underset{CH_2CH_2CH_3}{|}}{CH}-,$$

The photosensitive component in photothermographic materials according to the invention is photographic silver halide. An advantage of the described photothermographic materials is that the concentration of photographic silver halide needed to provide a developable image can be low compared to photographic materials which contain photographic silver halide in the absence of other of the described components of the photothermographic materials of the invention. For example, the concentration of photographic silver halide useful in photothermographic materials of the invention can be about 0.0025 to about 0.3 mole of photographic silver halide per mole of silver as the silver salt of the described heterocyclic thiones. In a photothermographic element of the invention, the concentration of photographic silver halide is typically about 0.02 times $10^{-3}$ to about 0.12 times $10^{-3}$ mole of silver halide per 929 square centimeters of support. Useful photographic silver halides include, for example, silver chloride, silver bromide, silver iodide, silver bromoiodide, silver chlorobromoiodide, or mixtures thereof. Photographic silver iodide is especially useful. The photographic silver halide can be coarse or fine-grain, very fine-grain photographic silver halide being especially useful. The photographic silver halide can be prepared by known procedures in the photographic art. The silver halide can be prepared, for example, employing single-jet preparation techniques, double-jet preparation techniques such as techniques employed in preparing Lippmann emulsions and the like. Surface image silver halide can be used. If desired, mixtures of surface and internal image silver halide can be used. Negative type silver halide is typically employed. The silver halide can be regular grain silver halide such as described in Klein and Moisar, *Journal of Photographic Science*, Volume 12, No. 5, September-October (1964), pages 242-251.

The photographic silver halide can be chemically sensitized employing techniques known in the photographic art.

It is believed that the latent image of the described photographic silver halide enables the reaction between the components of the photothermographic element according to the invention to proceed more efficiently and at lower temperatures than would be enabled in the absence of the photographic silver halide.

The term "photographic silver halide in association with" as employed herein is intended to mean that the silver halide is located within the photothermographic element or composition on or contiguous to the described image-forming combination. The silver halide can be, for example, in the same layer as the described image-forming combination or in a separate layer which is in reactive association with the layer containing the image-forming combination. This enables the described improved lower processing temperature.

Various thione compounds are useful for preparing the silver salt of the described heterocyclic thiones. Selection of an optimum heterocyclic thione silver salt will depend upon such factors as the particular photothermographic material, particular toning agent, processing temperature, desired image and the like.

The heterocyclic thione silver salts comprise a 5-member heterocyclic nucleus as described. Examples of suitable 5-member heterocyclic nuclei are those wherein R, as described, completes a thiazoline-2-thione, benzothiazoline-2-thione, imidazoline-2-thione, oxazoline-2-thione or similar heterocyclic thione nucleus. The heterocyclic nucleus can be substituted with groups which do not adversely affect the photothermographic or thermographic properties of the composition, such as alkyl containing 1 to 3 carbon atoms or phenyl.

Examples of useful thione compounds for preparing the described silver salts are represented by the formula:

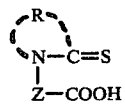

wherein

Z is alkylene containing 1 to 30 carbon atoms, such as 1 to 10 carbon atoms including, for example, methylene, ethylene, propylene and butylene;

R represents atoms completing a 5-member heterocyclic nucleus, such as a thiazoline-2-thione, benzothiazoline-2-thione, imidazoline-2-thione or oxazoline-2-thione nucleus.

The atoms representing R can be substituted with groups which do not adversely affect the photothermographic or thermographic properties of the composition, such as alkyl containing 1 to 3 carbon atoms or phenyl.

Thione compounds which are especially useful for preparation of the described silver salts of heterocyclic thiones are thiazoline-2-thiones represented by the formula:

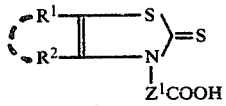

wherein $Z^1$ is alkylene containing 1 to 4 carbon atoms such as methylene, ethylene, propylene and butylene;

$R^1$ and $R^2$ are each, independently, hydrogen, alkyl containing 1 to 4 carbon atoms, such as methyl, ethyl, propyl or butyl, or aryl containing 6 to 10 carbon atoms such as phenyl or tolyl, or taken together are the atoms necessary to complete a benzo group. The alkyl, aryl and benzo groups can be substituted with groups which do not adversely affect the sensitometric properties of the composition or element. For example, the alkyl group can be substituted with hydroxy or phenyl and the aryl or benzo groups can be substituted with alkyl containing 1 to 4 carbon atoms.

Other thione compounds which are useful for preparing the described silver salts of a heterocyclic thione are, for example, imidazoline-2-thiones represented by the formula:

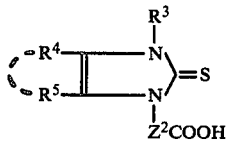

wherein $Z^2$ is alkylene containing 1 to 4 carbon atoms such as methylene, ethylene, propylene and butylene;

$R^3$ is alkyl, typically alkyl containing 1 to 3 carbon atoms, such as methyl, ethyl or propyl or aryl containing 6 to 10 carbon atoms, such as phenyl or carboxyalkyl, such as carboxyethyl and carboxymethyl, $R^4$ and $R^5$ are the same as defined for $R^1$ and $R^2$.

Further useful thione compounds for preparation of the described silver salts of heterocyclic thiones are oxazoline-2-thione represented by the formula:

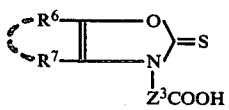

wherein $Z^3$ is alkylene containing 1 to 4 carbon atoms such as methylene, ethylene, propylene and butylene;

$R^6$ and $R^7$ are the same as defined for $R^1$ and $R^2$.

Examples of useful thione compounds for preparation of the described silver salts of heterocyclic thiones within the described formula include:

3-(2-carboxyethyl)-4-methyl-4-thiazoline-2-thione,
3-(2-carboxyethyl)benzothiazoline-2-thione,
3-(2-carboxyethyl)-5-phenyl-1,3,4-oxadiazoline-2-thione,
3-(2-carboxyethyl)-5-phenyl-1,3,4-thiadiazoline-2-thione,
3-carboxymethyl-4-methyl-4-thiazoline-2-thione,
3-(2-carboxyethyl)-1-phenyl-1,3,4-triazoline-2-thione,
1,3-bis(2-carboxyethyl)imidazoline-2-thione,
1,3-bis(2-carboxyethyl)benzimidazoline-2-thione,
3-(2-carboxyethyl)-1-methylimidazoline-2-thione,
3-(2-carboxyethyl)benzoxazoline-2-thione, and
3-(1-carboxyethyl)-4-methyl-4-thiazoline-2-thione.

The silver salt of the described heterocyclic thione can be prepared directly in the photothermographic composition or thermographic composition by combining a source of silver, such as silver trifluoroacetate, with the described heterocyclic thione in the composition, or the silver salts can be preformed and isolated before addition to the photothermographic or thermographic composition. The described thione compounds can be prepared employing procedures known in the art. It is desirable to avoid preparation of the silver salt of the heterocyclic thione in the presence of compounds which could cause undesired reduction.

Preparation of the heterocyclic thione compounds can be carried out employing procedures described, for example, in an article of R. W. Lamon and W. J. Humphlett, *Journal of Heterocyclic Chemistry*, Vol. 4, pages 605–609 (1967) or as described in Belgian Pat. No. 739,705. 4-Thiazoline-2-thiones bearing a carboxyalkyl group on the nitrogen atom in the thiazoline nucleus can, for example, be prepared by treating a dithiocarbamic acid derived from an amino acid and carbon disulfide with an α-halogenated ketone. In this process the use of methyl alcohol as a solvent can improve the solubility of the reactants.

The preparation of the silver salt of 3-carboxymethyl-4-methyl-4-thiazoline-2-thione is typical. This silver complex is prepared by mixing the described thiazoline-2-thione with silver trifluoroacetate in water and thoroughly dispersing the reactants. Concentrations of the reactants can be varied to provide the desired ratio of silver to heterocyclic compound. Typically, the ratio of the thione compound to silver ion is about 2:1. For example, the described dispersion can contain about 9.6 milligrams of silver/ml. dispersion. The resulting silver salt can be purified and stored for later mixture with other components of the desired phototherographic or thermographic materials. The dispersing of the silver trifluoroacetate with the heterocyclic compound is typically carried out at about 38° C. to about 71° C.

Various reducing agents, also described herein as developing agents, are useful in the phototherographic and thermographic materials of the invention. These are typically silver halide developing agents and include, for example, polyhydroxybenzenes such as hydroquinones including, for instance, hydroquinone, alkyl-substituted hydroquinone, such as tertiary butyl hydroquinone, methyl hydroquinone, ethyl hydroquinone, 2,5-dimethyl hydroquinone and 2,6-dimethyl hydroquinone; catechols and pyrogallol; halo-substituted hydroquinone such as chlorohydroquinone or dichlorohydroquinone; alkoxy-substituted hydroquinones such as methoxy hydroquinone or ethoxy hydroquinone and the like. Other reducing agents which can be employed include reductones such as anhydro dihydro piperidino hexose reductone; hydroxy tetronic acids and hydroxy tetronic imides; 3-pyrazolidones such as 1-phenyl-3-pyrazolidone, 3',4,4-trimethyl-1-phenyl-3-pyrazolidone, 4-hydroxymethyl-2-[N-(p-hydroxyphenyl)-N-methylamino-methyl]-4-methyl-1-phenyl-3-pyrazolidinone, 4-methyl-4-hydroxymethyl-1-phenyl-3-pyrazolidone; hydroxylamines; ascorbic acid reducing agents, such as ascorbic acid, ascorbic acid ketals and other ascorbic acid derivatives; phenylenediamines; aminophenols; pyrimidine reducing agents, such as 2-isopropyl-4,5,6-trihydroxypyrimidine, N-methyl-2-isopropyl-4,5,6-trihydroxypyrimidine and N-phenyl-2-phenyl-4,5,6-trihydroxypyrimidine, and the like. Combinations of reducing agents can be employed if desired. A useful reducing agent or reducing agent combination is one in which the photothermographic or thermographic materials of the invention provide a developed image within about 90 seconds at a temperature of about 100° C. to about 250° C.

A binder is useful, although not essential, in the photothermographic and thermographic materials according to the invention. Useful binders can be hydrophilic or hydrophobic, transparent or translucent and include both naturally-occurring substances such as proteins, for example, gelatin, gelatin derivatives, cellulose derivatives, polysaccharides such as dextran, gum arabic and the like; and synthetic polymeric substances, such as acrylamide polymers.

The photothermographic element or thermographic element of the invention can employ a wide variety of supports. Typical supports include those that are resistant to distortion at the processing temperatures employed for developing an image in the elements of the invention. Typical supports include cellulose nitrate film, cellulose ester film, poly(vinyl acetal) film, polystyrene film, poly(ethylene terephthalate) film, poly(ethylene 2,6-naphthylene dicarboxylate), polyesters of 1,1,3-trimethyl-3-(p-carboxyphenyl)-5-carboxyindan and bisphenols, as described in U.S. Pat. No. 3,634,089 issued Jan. 11, 1972, polycarbonate film and related films or resinous materials, as well as glass, paper, metal and the like. Typically, a flexible support is employed, such as a paper support which can be partially acetylated or coated with baryta or with an $\alpha$-olefin polymer which is a polymer of an $\alpha$-olefin containing 2 to 10 carbon atoms such as polyethylene, polypropylene, ethylene-butene copolymers and the like.

The photothermographic elements and compositions according to the invention can contain addenda commonly employed in photothermographic elements and compositions, such as antistatic and/or conducting materials, plasticizers, lubricants, surfactants, matting agents, brightening agents, light-absorbing materials, filter dyes, antihalation dyes and absorbing dyes, and the like.

Spectral sensitizing dyes can be useful to confer additional sensitivity to the light sensitive silver halide in the materials according to the invention. For instance, additional sensitization can be obtained by treating the silver halide with a solution of a sensitizing dye in an organic solvent or the dye can be added in the form of a dispersion. Spectral sensitizers which can be useful include the cyanines, merocyanines, complex(trinuclear or tetranuclear) merocyanines, complex(trinuclear or tetranuclear) cyanines, homopolar cyanines, styryls, hemicyanines, such as enamines, oxonols, and hemioxonols.

The various components of the photothermographic materials or thermographic materials of the invention can be added from water solutions or suitable organic solvents can be used to aid in addition. The components can be mixed using various procedures known in the photographic art.

The photothermographic and thermographic compositions according to the invention can be coated on a support by various coating procedures including dip coating, air knife coating, curtain coating or extrusion coating using hoppers of the type described in U.S. Pat. No. 2,681,294 of Beguin, issued June 15, 1954. If desired, two or more layers of the photothermographic element or thermographic element according to the invention can be coated simultaneously by procedures known in the photographic art.

An especially useful embodiment of the invention is a photothermographic element comprising a support having thereon, in sequence, (I) a layer consisting of an acrylamide copolymer, (II) a layer comprising (a) photographic silver iodide in association with (b) an image-forming combination comprising (i) a silver salt of 3-carboxymethyl-4-methyl-4-thiazoline-2-thione, (ii) a hydroquinone silver halide developing agent, (c) an acrylamide copolymer binder, and (d) a toner comprising 3-mercapto-1H-1,2,4-triazole, and (III) a layer consisting of an acrylamide copolymer.

Acrylamide copolymers which are useful in the described photothermographic element of the invention include, for example, acrylamide copolymers described in U.S. Pat. No. 3,893,860 of Sutton and Stapelfeldt.

Another embodiment of the invention is a photothermographic composition comprising (a) photographic silver halide in association with (b) an image-forming combination comprising a silver salt of a heterocyclic thione as described, with (ii) an organic reducing agent also as described and (c) a mercapto heterocyclic toner which satisfies the described test, preferably a 3-mercapto-1H-1,2,4-triazole, 3-imino-5-thiourazole, 4-methyl-3,5-dithiourazole, 4-phenyl-3,5-dithiourazole, 4-(p-methoxyphenyl)-3,5-dithiourazole, 2,4-dimercaptopyrimidine, 8-mercaptopurine or 2,6-dimercaptopurine toner.

A range of concentration of each component is useful in the described photothermographic and thermographic materials of the invention. Typically, a photothermographic element according to the invention can comprise a support having thereon (a) about 0.02 times $10^{-3}$ to about 0.12 times $10^{-3}$ mole of photographic silver halide, (b) about 0.125 times $10^{-3}$ to about 1.0 times $10^{-3}$ mole of reducing agent and (c) about 0.5 times $10^{-3}$ to about 2 times $10^{-3}$ mole of silver as the described complex of silver with the heterocyclic thione, per 929 square centimeters of support. A preferred concentration is about 0.1 times $10^{-2}$ mole of the mercapto heterocyclic toner per mole of total silver in the photothermographic or thermographic material. The photothermographic element typically contains about 0.09 times $10^{-5}$ mole to about 5.5 times $10^{-5}$ mole of described toning agent per 929 square centimeters of support. The selection of an optimum concentration of a toning agent will depend upon such factors as the particular toning agent, the particular components of the photothermographic material, processing conditions, desired image and the like. Typical concentration ranges for various toning agents are as follows:

mercapto thiazoles: 0.01–0.07 g/m$^2$ of support
mercapto thiadiazoles: 0.003–0.07 g/m$^2$ of support
mercapto 1,2,4-triazoles: 0.002–0.07 g/m$^2$ of support
thiourazoles: 0.003–0.07 g/m$^2$ of support
mercapto pyrimidines: 0.001–0.02 g/m$^2$ of support
mercapto purines: 0.005–0.02 g/m$^2$ of support Another embodiment of the invention accordingly is a photothermographic composition comprising (a) photographic silver halide in association with (b) about 2 to about 35 moles as silver of the described silver salt of a heterocyclic thione per mole of said silver halide, (c) about 2 to about 15 moles of the reducing agent per mole of the silver halide, and (d) about 0.05 to about 1.0 mole of the described toner per mole of the silver halide.

Various imagewise exposure means are useful with photothermographic and thermographic elements according to the invention. Photothermographic materials according to the invention are typically sensitive to the ultraviolet and blue regions of the spectrum and exposure means which provide this radiation are preferred. Typically, a photothermographic element according to the invention is exposed imagewise with a visible light source such as a tungsten lamp.

The exposure means useful for a thermographic element according to the invention will depend upon such factors as the particular components of the thermographic element, desired image, particular toning agent and the like. Typically, imagewise heating of a thermographic element is provided with an infrared lamp or other heating means such as a heated drum or heated platen.

A visible image can be developed in a photothermographic element as described, after imagewise exposure, within a short time, by overall heating the photothermographic element. For example, the photothermographic element can be overall heated for about 1 to about 90 seconds at a temperature of about 100° C. to about 250° C., preferably about 140° C. to about 170° C. Usually the time of heating is less than about 20 seconds, such as about 1 to about 4 seconds at a temperature of about 150° C. to about 170° C. Increasing or decreasing the length of time of heating can enable use of a higher or lower temperature within the described range.

Any suitable means can be used for providing the desired processing temperature range. The heating means can be, for example, a simple hot plate, iron or roller; or hot air convection heating means; or dielectric heating means.

An especially useful photothermographic composition according to the invention comprises (a) photographic silver halide in association with (b) an image-forming combination comprising (i) a silver salt of 3-carboxymethyl-4-methyl-4-thiazoline-2-thione in association with (ii) an organic reducing agent, preferably a hydroquinone silver halide developing agent, and (c) a toner which is 3-mercapto-1H-1,2,4-triazole, 3-imino-5-thiourazole, 4-methyl-3,5-dithiourazole, 4-phenyl-3,5-dithiourazole, 4-(p-methoxyphenyl)-3,5-dithiourazole, 2,4-dimercaptopyrimidine, 8-mercaptopurine and 2,6-dimercaptopurine.

Another embodiment of the invention is a toner-silver salt composition comprising a silver salt of a heterocyclic thione as described, with a toner, also as described.

The toner-silver salt composition can also comprise a reducing agent for the silver salt of the heterocyclic thione. Useful reducing agents are as described.

The toner-silver salt composition can also comprise a polymeric binder, as described.

A typical toner-silver salt composition comprises (1) a silver salt of 3-carboxymethyl-4-methyl-4-thiazoline-2-thione in association with (2) a hydroquinone reducing agent, such as tertiary butyl hydroquinone, and (3) 3-mercapto-1H-1,2,4-triazole.

A further embodiment of the invention is a thermographic element comprising a support having thereon (a) a silver salt of a heterocyclic thione as described, in association with (b) an organic reducing agent for the silver salt of the heterocyclic thione, and (c) a toner which is a 3-mercapto-1H-1,2,4-triazole, 3-imino-5-thiourazole, 4-methyl-3,5-dithiourazole, 4-phenyl-3,5-dithiourazole, 4-(p-methoxyphenyl)-3,5-dithiourazole, 2,4-dimercaptopyrmidine, 8-mercaptopurine and 2,6-dimercaptopurine toner.

An image in such a thermographic element can be developed by imagewise heating the thermographic element to a temperature of about 100° C. to about 250° C., preferably about 140° C. to about 180° C.

The following examples are included for a further understanding of the invention.

EXAMPLES 1–10

A silver salt dispersion was prepared by reacting 3-carboxymethyl-4-methyl-4-thiazoline-2-thione with silver trifluoroacetate in water and mixing the reactants thoroughly. The concentrations of reactants were selected to provide and maintain a solution ratio of thione compound to silver ion of about 1.6:1. This concentration usually provides 9.6 milligrams of silver in each milliliter of the developing dispersion. Thi silver salt dispersion was designated as Dispersion A.

A photothermographic element was prepared by coating on a resin coated paper support a coating composition containing the following:

silver salt Dispersion A: 7.0 ml reducing agent (10% by weight solution 1.0 ml in methanol):

silver iodide gelatino emulsion (21.2 0.4 ml milligrams of silver in each ml of emulsion):

Surfactant IOG (0.5% by weight 0.4 ml solution in alcohol; the surfactant is nonylphenoxypolyglycidol available from Olin Corp., U.S.A.):

toning agent (concentration is given in following Table I)

In order to aid mixing of the toning agents with other components of the described composition, the toning agent was dissolved in methanol with the reducing agent when incorporated with the other components of the coating formulation.

The coating mixture was coated on the paper support at 6.9 times $10^{-4}$ moles of total silver per 929 square centimeters of support. No separate binding agent was employed in the photothermographic composition.

The resulting photothermographic element was imagewise exposed to tungsten light to provide a developable image. The exposed photothermographic element was then uniformly heated by contacting it with a metal block at 150° C. for 4 seconds.

The particular toning agent, concentration of toning agent in the coating mixture, particular reducing agent, Dmax, Dmin and developed image tone are given in following Table I.

Table I

| Example No. | Toning Agent | Concentration of Toning Agent in Coating Mixture | Reducing Agent | Dmax | Dmin | Image Tone |
|---|---|---|---|---|---|---|
| 1 | 3-mercapto-1H-1,2,4-triazole | 1.0 mg | hydroquinone | 1.07 | 0.10 | neutral |
| 2 | 3-mercapto-1H-1,2,4-triazole | 1.0 mg | methyl hydroquinone | 1.42 | 0.08 | neutral |
| 3 | 3-imino-4-phenyl-1, 2,4-triazolidine-5-thione | 2.5 mg | methyl hydroquinone | 1.52 | 0.08 | reddish neutral |
| 4 | 2-mercaptothiazole | 6.0 mg | methyl hydroquinone | 1.37 | 0.10 | reddish neutral |
| 5 | 3,5-dithiourazole | 1.0 mg | methyl hydroquinone | 1.22 | 0.10 | reddish neutral |
| 6 | 5-amino-2-mercapto-1,3,4-thiadiazole | 4.0 mg | methyl hydroquinone | 1.35 | 0.09 | reddish neutral |
| 7 | 2,5-dimercapto-1,3,4- | 2.0 mg | methyl hydroquinone | 1.35 | 0.10 | neutral |

Table I-continued

| Example No. | Toning Agent | Concentration of Toning Agent in Coating Mixture | Reducing Agent | Dmax | Dmin | Image Tone |
|---|---|---|---|---|---|---|
| | thiadiazole | | | | | |
| 8 | 2,4-dimercaptopyrimidine | 0.5 mg | methyl hydroquinone | 1.38 | 0.09 | neutral |
| 9 | 8-mercaptopurine | 1.0 mg | methyl hydroquinone | 1.38 | 0.25 | neutral |
| 10 | 2,6-dimercaptopurine | 1.0 mg | methyl hydroquinone | 1.27 | 0.29 | neutral |
| Control A | None (comparative example) | — | hydroquinone | 1.00 | 0.11 | brown |
| Control B | None (comparative example) | — | methyl hydroquinone | 1.08 | 0.13 | brown |

EXAMPLE 11

This is a comparative example.

The procedure described in Example 1 was repeated with 6 milligrams of 5-mercapto-1-phenyl-1H-tetrazole added in place of the described toning agent. The developed image tone was brown. This tone was the same as the comparative examples in which no toning agent was employed as described in Table I.

EXAMPLE 12

A silver salt of 3-carboxymethyl-4-methyl-4-thiazoline-2-thione was prepared as described in Example 1 to provide a silver salt Dispersion A.

A coating composition was prepared by mixing the following in an aqueous solvent:

silver salt Dispersion A: 7.0 ml tertiary butyl hydroquinone (18.8% 1.0 ml by weight solution in methanol):

fine-grain photographic gelatino silver iodide emulsion (each milliliter of emulsion contained 21.2 milligrams of silver; the silver iodide had an average grain size of about 0.06 microns): 0.4 ml Surfactant 10G (nonylphenoxypolyglycidol available from Olin Corp., U.S.A.): 0.4 ml mercapto heterocyclic toner as indicated in following Table II The resulting composition containing the mercapto heterocyclic toner was then coated onto a polyethylene coated paper support at the concentration which provided a coating containing per square meter of support, 0.75 gram of total silver of which 0.08 gram was contributed by the silver iodide. The coating contained per square meter of support 1.88 grams of tertiary butyl hydroquinone, 0.022 g. of coating aid and 0.001 to 0.07 gram of the described mercapto heterocyclic toner. The coating contained no separate binder. The resulting coating was dried to provide a photothermographic element.

The photothermographic element was imagewise exposed to unfiltered tungsten light sufficient to provide a latent image which was developable. The exposed photothermographic element was then overall heated by contacting it with a metal block at about 160° C. for about 2 to about 8 seconds to provide a visible developed image having a developed density of at least 1.0.

The blue reflection density of the developed image was then measured employing a conventional densitometer with a tungsten light source which was filtered to permit only the blue wavelengths to be reflected. Also, the visual reflection density was measured employing a densitometer with a filter. which permitted the visual wavelengths of the spectrum to be reflected. The difference between the blue reflection density (X) of the image and the visual reflection density (Y) of the developed image was assigned the designation of delta D, also described as ΔD. The difference between the blue reflection density (X) and the visual reflection density (Y) of the developed image was measured at 1.0 density of the developed image.

An arbitrary toner activity rating was assigned to each compound. Those compounds that provided a difference between blue reflection density (X) and visual reflection density (Y) of 0.00 to 0.15 were considered to be preferred toners in the described photothermographic material. In some cases compounds which provided a difference between blue reflection density (X) and visual reflection density (Y) of greater than about 0.21 provided other undesired effects such as undesired fogging, restraining of development and the like.

The results are given in following Table II. Those examples in Table II which provided a delta D range of 0.21 or greater are comparative examples.

Table II

| Ex. No. | Compound Tested* | ΔD |
|---|---|---|
| | Control (no toner(s) present) | 0.35 |
| 12 | 2-mercaptoimidazole | 0.35 |
| 13 | 1-methyl-2-mercaptoimidazole | 0.32 |
| 14 | 2-mercaptobenzimidazole | 0.35 |
| 15 | 2-thiohydantoin | 0.26 |
| 16 | 2-mercaptothiazole | 0.30 |
| 17 | 2-mercaptobenzothiazole | 0.35 |
| 18 | rhodanine | 0.27 |
| 19 | 1H-1,2,4-triazole | 0.33 |
| 20 | 3-mercapto-1H-1,2,4-triazole | 0.12 |
| 21 | 3-mercapto-4-phenyl-1,2,4-triazole | 0.22 |
| 22 | 5-ethyl-3-mercapto-4-phenyl-1,2,4-triazole | 0.23 |
| 23 | 3-mercapto-5-methyl-4-phenyl-1,2,4-triazole | 0.20 |
| 24 | 3-methylthio-4-phenyltriazoline-5-thione | 0.24 |
| 25 | 3-imino-4-phenyl-1,2,4-triazolidine-5-thione | 0.26 |
| 26 | 5-thiourazole | 0.20 |
| 27 | 4-carboxymethyl-5-thiourazole | 0.27 |
| 28 | 3-imino-5-thiourazole | 0.13 |
| 29 | 3,5-dithiourazole | 0.30 |
| 30 | 4-methyl-3,5-dithiourazole | 0.17 |
| 31 | 4-phenyl-3,5-dithiourazole | 0.18 |
| 32 | 4-butyl-3,5-dithiourazole | 0.21 |
| 33 | 4-(p-methoxyphenyl)-3,5-dithiourazole | 0.19 |
| 34 | 4-(p-nitrophenyl)-3,5-dithourazole | 0.27 |
| 35 | 2,5-dimercapto-1,3,4-thiadiazole | 0.21 |
| 36 | 5-amino-2-mercapto-1,3,4-thiadiazole | 0.22 |
| 37 | 2-mercapto-4-phenyl-1,3,4-thiadiazoline-5-thione, K salt | 0.30 |
| 38 | 2,5-bis(methylthio)1,3,4-thiadiazole | 0.29 |
| 39 | 5-mercapto-1-phenyl-1H-tetrazole | 0.32 |
| 40* | 5-mercapto-1-phenyl-1H-tetrazole | 0.31 |
| 41 | 2,4-dimercaptopyrimidine | 0.14 |
| 42 | 2-mercapto-4,6-dimethylpyrimidine · HCl | 0.31 |
| 43 | 2-mercaptopyrimidine | 0.30 |
| 44 | 8-mercaptopurine | 0.04 |
| 45 | 2,6-dimercaptopurine | 0.14 |
| 46 | 2,6,8-trimercaptopurine | 0.33 |
| 47 | 3-methylthiotriazoline-5-oxone | 0.33 |
| 48 | 2-mercapto-5-phenyl-1,3,4-oxadiazole | 0.33 |
| 49 | 1-methyl-1,2,3,6-tetrahydro-1,3,5-triazine-4-thiol | 0.32 |
| 50 | 4-mercaptopyridine | 0.29 |
| 51 | diethylaminoethanethiol | 0.35 |
| 52 | L-(+)-cysteine · HCl | 0.34 |

Table II-continued

| Ex. No. | Compound Tested* | ΔD |
|---|---|---|
| 53 | 4-carboxymethyl-4-thiazoline-2-thione | 0.33 |

*Repeat with Compound of Examples 39 to confirm ΔD value.
*The individually tested compounds in Examples 12-53 were tested in the following concentrations:
6 mg. in each of Examples 12-14, 16, 17, 19, 21, 23, 24, 37, 39, 40, 47-49 and 51-53.
1 mg. in each of Examples 15, 18, 20, 29, 30, 38, 42-46 and 50.
2 mg. in each of Examples 26, 28, and 31-35.
2.5 mg. in Example 25.
4 mg. in Examples 22, 27 and 36.
0.5 mg. in Example 41.

EXAMPLE 55

The procedure described in Example 1 was repeated with the exception that 2.5 mg./dm.$^2$ of L-(+) ascorbic acid was employed in place of hydroquinone as the reducing agent. Additionally the photothermographic material contained 7.5 mg./dm.$^2$ of a solid solvent which was resorcinol as described in U.S. Pat. No. 3,438,776 of Yudelson. A developed image resulted upon imagewise exposure and overall heating of the element. This provided a developed image having a maximum density of 1.64 and a minimum density of 0.08.

EXAMPLE 56

The procedure described in Example 1 was repeated with the exception that 12 mg./dm.$^2$ of 2-isopropyl-4,5,6-trihydroxypyrimidine was employed as a reducing agent in place of hydroquinone. Additionally the photothermographic material contained 12 mg./dm.$^2$ of a solid solvent which was resorcinol as described in U.S. Pat. No. 3,438,776 of Yudelson. Upon imagewise exposure and heating of the resulting element as described in Example 1, a developed image was produced having a maximum density of 1.62 and a minimum density of 0.09.

EXAMPLE 57

The procedure described in Example 1 was repeated with the exception that 10 mg./dm.$^2$ of anhydro dihydro piperidino hexose reductone was employed as the reducing agent in place of hydroquinone. Additionally the photothermographic material contained 10 mg./dm.$^2$ of a solid solvent which was resorcinol as described in U.S. Pat. No. 3,438,776 of Yudelson. Upon imagewise exposure and heating of the resulting photothermographic element, a developed image was produced having a maximum density of 1.77 and a minimum density of 0.16.

EXAMPLE 58

The procedure described in Example 1 was repeated with the exception that 10 mg./dm.$^2$ of 1-phenyl-3-pyrazolidone was employed as a reducing agent in place of hydroquinone. Additionally the photothermographic material contained 10 mg./dm.$^2$ of a solid solvent which was resorcinol as described in U.S. Pat. No. 3,438,776 of Yudelson. Upon imagewise exposure and overall heating the resulting photothermographic element as described in Example 1, a developed image was produced having a maximum density of 1.28 and a minimum density of 0.37.

With most of the mercapto heterocyclic toning agents of the invention it is desirable to avoid processing temperatures which are significantly above that which provides a developed image. If processing temperatures above that required to provide a developed image are used, decreases in desired image tone can occur. For example, when using mercapto-1H-1,2,4-triazole as a toning agent, it is usually desirable to avoid processing temperatures above 160° C. Above 160° C. this toning agent may tend to produce less than a neutral black image.

EXAMPLE 59

The procedure of Example 12 was repeated with 1.0 ml of poly(vinyl alcohol) added as a 10% by weight solution in water. The poly(vinyl alcohol) was used as an added binder. The resulting use of this added binder provided no adverse effects on toning or processing results. It did provide an increase in the ease of coating of the photothermographic composition on the support.

The invention has been described in detail with particular reference to preferred embodiments thereof, but it will be understood that variations and modifications can be effected within the spirit and scope of the invention.

What is claimed is:

1. In a photothermographic element comprising a support having thereon
(a) photographic silver halide in association with
(b) an image-forming combination comprising
(i) a silver salt of a heterocyclic thione, said heterocyclic thione being represented by the formula:

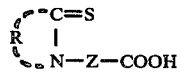

wherein R represents atoms completing a 5-member heterocyclic nucleus, Z is alkylene containing 1 to 30 carbon atoms,
(ii) an organic reducing agent, and
(c) a toner,
the improvement wherein said toner comprises a mercapto heterocyclic compound which is selected from the group consisting of 3-mercapto-1H-1,2,4-triazole, 3-imino-5-thiourazole, 4-methyl-3,5-dithiourazole, 4-phenyl-3,5-dithiourazole, 4-(p-methoxyphenyl)-3,5-dithiourazole, 2,4-dimercaptopyrimidine, 8-mercaptopurine and 2,6-dimercaptopurine toners.

2. A photothermographic element comprising a support having thereon
(a) photographic silver halide in association with
(b) an image-forming combination comprising
(i) a silver salt of a heterocyclic thione, said heterocyclic thione being represented by the formula:

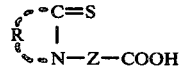

wherein R represents atoms completing a 5-member heterocyclic nucleus, Z is alkylene containing 1 to 30 carbon atoms,
(ii) a hydroquinone reducing agent, and
(c) a toner which is 3-mercapto-1H-1,2,4-triazole.

3. A photothermographic element comprising a support having thereon
(a) photographic silver halide in association with
(b) an image-forming combination comprising
(i) a silver salt of 3-carboxymethyl-4-methyl-4-thiazoline-2-thione in association with (ii) an organic reducing agent, and
(c) a toner which is 3-imino-5-thiourazole, 4-methyl-3,5-dithiourazole, 4-phenyl-3,5-dithiourazole, or 4-(p-methoxyphenyl)-3,5-dithiourazole.

4. A photothermographic element comprising a support having thereon
(a) a photographic silver halide in association with
(b) an image-forming combination comprising
(i) a silver salt of 3-carboxymethyl-4-methyl-4-thiazoline-2-thione in association with
(ii) an organic reducing agent, and
(c) a toner which is 2,4-dimercaptopyrimidine.

5. A photothermographic element comprising a support having thereon
(a) photographic silver halide in association with
(b) an image-forming combination comprising
(i) a silver salt of 3-carboxymethyl-4-methyl-4-thiazoline-2-thione in association with
(ii) an organic reducing agent, and
(c) a toner which is 8-mercaptopurine or 2,6-dimercaptopurine.

6. A photothermographic element comprising a support having thereon
(a) photographic silver iodide in association with
(b) an image-forming combination comprising
(i) a silver salt of 3-carboxymethyl-4-methyl-4-thiazoline-2-thione,
(ii) a hydroquinone silver halide developing agent,
(c) a polymeric binder, and
(d) a toner comprising 3-mercapto-1H-1,2,4-triazole.

7. A photothermographic element comprising a support having thereon, in sequence, (I) a layer consisting of an acrylamide copolymer, (II) a layer comprising
(a) photographic silver iodide in association with
(b) an image-forming combination comprising
(i) a silver salt of 3-carboxymethyl-4-methyl-4-thiazoline-2-thione,
(ii) a hydroquinone silver halide developing agent,
(c) an acrylamide copolymer binder, and
(d) a toner comprising 3-mercapto-1H-1,2,4-triazole, and (III) a layer consisting of an acrylamide copolymer.

8. In a photothermographic composition comprising
(a) photographic silver halide in association with
(b) an image-forming combination comprising
(i) a silver salt of a heterocyclic thione, said heterocyclic thione being represented by the formula:

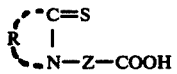

wherein R represents atoms completing a 5-member heterocyclic nucleus, Z is alkylene containing 1 to 30 carbon atoms,
(ii) an organic reducing agent, and
(c) a toner, the improvement wherein said toner comprises a mercapto heterocyclic compound which is selected from the group consisting of 3-mercapto-1H-1,2,4-triazole, 3-imino-5-thiourazole, 4-methyl-3,5-dithiourazole, 4-phenyl-3,5-dithiourazole, 4-(p-methoxyphenyl)-3,5-dithiourazole, 2,4-dimercaptopyrimidine, 8-mercaptopurine and 2,6-dimercaptopurine toners.

9. A photothermographic composition comprising
(a) photographic silver halide in association with
(b) an image-forming combination comprising
(i) a silver salt of 3-carboxymethyl-4-methyl-4-thiazoline-2-thione,
(ii) an organic reducing agent, and
(c) a toner which is 3-mercapto-1H-1,2,4-triazole.

10. A photothermographic composition comprising
(a) photographic silver halide in association with
(b) an image-forming combination comprising
(i) a silver salt of 3-carboxymethyl-4-methyl-4-thiazoline-2-thione,
(ii) an organic reducing agent, and
(c) a toner which is 3-imino-5-thiourazole, 4-methyl-3,5-dithiourazole, 4-phenyl-3,5-dithiourazole, or 4-(p-methoxyphenyl)-3,5-dithiourazole.

11. A photothermographic composition comprising
(a) photographic silver halide in association with
(b) an image-forming combination comprising
(i) a silver salt of 3-carboxymethyl-4-methyl-4-thiazoline-2-thione,
(ii) an organic reducing agent, and
(c) a toner which is 2,4-dimercaptopyrimidine.

12. A photothermographic composition comprising
(a) photographic silver halide in association with
(b) an image-forming combination comprising
(i) a silver salt of 3-carboxymethyl-4-methyl-2-thione,
(ii) an organic reducing agent, and
(c) a toner which is 8-mercaptopurine or 2,6-dimercaptopurine.

13. A photothermographic composition comprising
(a) photographic silver iodide in association with
(b) an image-forming combination comprising
(i) a silver salt of 3-carboxymethyl-4-methyl-4-thiazoline-2-thione,
(ii) an organic reducing agent,
(c) a polymeric binder, and
(d) a toner comprising 3-mercapto-1H-1,2,4-triazole.

14. In a toner-silver salt composition comprising
(a) a silver salt of a heterocyclic thione, said heterocyclic thione being represented by the formula:

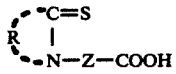

wherein R represents atoms completing a 5-member heterocyclic nucleus, Z is alkylene containing 1 to 30 carbon atoms, and
(b) a toner the improvement wherein said toner comprises a mercapto heterocyclic compound selected from the group consisting of 3-mercapto-1H-1,2,4-triazole, 3-imino-5-thiourazole, 4-methyl-3,5-dithiourazole, 4-phenyl-3,5-dithiourazole, 4-(p-methoxyphenyl)-3,5-dithiourazole, 2,4-dimercaptopyrimidine, 8-mercaptopurine and 2,6-dimercaptopurine toners.

15. A toner-silver salt composition as in claim 14 also comprising a reducing agent for said silver salt.

16. A toner-silver salt composition as in claim 14 also comprising a polymeric binder.

17. A toner-silver salt composition comprising
(1) a silver salt of 3-carboxymethyl-4-methyl-4-thiazoline-2-thione in association with
(2) t-butyl hydroquinone, and
(3) 3-mercapto-1H-1,2,4-triazole.

18. In a thermographic element comprising a support having thereon (a) a silver salt of a heterocyclic thione, said heterocyclic thione being represented by the formula:

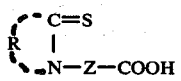

wherein R represents atoms completing a 5-member heterocyclic nucleus, Z is alkylene containing 1 to 30 carbon atoms in association with (b) an organic reducing agent for said silver salt, and (c) a toner the improvement wherein said toner is selected from the group consisting of 3-mercapto-1H-1,2,4-triazole, 3-imino-5-thiourazole, 4-methyl-3,5-dithiourazole, 4-phenyl-3,5-dithiourazole, 4-(p-methoxyphenyl)-3,5-dithiourazole, 2,4-dimercaptopyrimidine, 8-mercaptopurine and 2,6-dimercaptopurine toners.

19. In a thermographic element comprising a support having thereon (a) a silver salt of 3-carboxymethyl-4-methyl-4-thiazoline-2-thione in association with (b) an organic reducing agent for said silver salt, and (c) a toner the improvement wherein said toner is 3-mercapto-1H-1,2,4-triazole.

20. In a thermographic element comprising a support having thereon (a) a silver salt of 3-carboxymethyl-4-methyl-4-thiazoline-2-thione in association with (b) an organic reducing agent for said silver salt, and (c) a toner the improvement wherein said toner is 3-imino-5-thiourazole, 4-methyl-3,5-dithiourazole, 4-phenyl-3,5-dithiourazole, or 4-(p-methoxyphenyl)-3,5-dithiourazole.

21. In a thermographic element comprising a support having thereon (a) a silver salt of 3-carboxymethyl-4-methyl-4-thiazoline-2-thione in association with (b) an organic reducing agent for said silver salt, and (c) a toner the improvement wherein said toner is 2,4-dimercaptopyrimidine.

22. In a thermographic element comprising a support having thereon (a) a silver salt of 3-carboxymethyl-4-methyl-4-thiazoline-2-thione in association with (b) an organic reducing agent for said silver salt, and (c) a toner the improvement wherein said toner is 8-mercaptopurine or 2,6-dimercaptopurine.

23. A process of developing an image in a thermographic element as defined in claim 18 comprising imagewise heating said thermographic element to a temperature of about 100° C. to about 180° C.

* * * * *

UNITED STATES PATENT AND TRADEMARK OFFICE

CERTIFICATE OF CORRECTION

PATENT NO. : 4,201,582

DATED : May 6, 1980

INVENTOR(S) : Richard L. White

It is certified that error appears in the above-identified patent and that said Letters Patent are hereby corrected as shown below:

In the Abstract, line 8, after "salt of" insert ---the---.

Column 8, line 28, "desired phototherographic" should read ---described photothermographic---; line 33, "phototherographic" should read ---photothermographic---.

Column 12, line 22, "Thi" should read ---This---.

Signed and Sealed this

Ninth Day of December 1980

[SEAL]

Attest:

SIDNEY A. DIAMOND

Attesting Officer

Commissioner of Patents and Trademarks